US009646520B2

(12) United States Patent
Mokros

(10) Patent No.: US 9,646,520 B2
(45) Date of Patent: May 9, 2017

(54) FLAG/TEAM WAVE SYSTEM

(71) Applicant: Robert K. Mokros, Spring Hill, FL (US)

(72) Inventor: Robert K. Mokros, Spring Hill, FL (US)

( * ) Notice: Subject to any disclaimer, the term of this patent is extended or adjusted under 35 U.S.C. 154(b) by 0 days.

(21) Appl. No.: 15/271,432

(22) Filed: Sep. 21, 2016

(65) Prior Publication Data

US 2017/0039903 A1 Feb. 9, 2017

Related U.S. Application Data

(63) Continuation-in-part of application No. 15/082,787, filed on Mar. 28, 2016, now abandoned.

(60) Provisional application No. 62/193,946, filed on Jul. 17, 2015.

(51) Int. Cl.
*G09F 17/00* (2006.01)
*G09F 21/02* (2006.01)

(52) U.S. Cl.
CPC ..... *G09F 17/00* (2013.01); *G09F 21/02* (2013.01); *G09F 2017/0075* (2013.01)

(58) Field of Classification Search
CPC ..... A63B 57/357; B60Q 7/00; B60Q 7/005; B60Q 7/02; G09F 17/00; G09F 2017/005; G09F 2017/0075; G09F 21/00; G09F 21/02; G09F 21/026; G09F 21/04; G09F 21/048; G09F 2021/023
USPC ..... 116/28 R, 30, 173, 174, 175; 40/586, 40/588, 589, 590, 591, 592; 224/219, 224/220, 221, 901.4, 901.8; 446/248; 471/176; D11/165
See application file for complete search history.

(56) References Cited

U.S. PATENT DOCUMENTS

RE28,289 E * 12/1974 Calkins ..... B43K 23/001 211/69.1
3,926,139 A * 12/1975 Sabin ..... G09F 17/00 116/173
4,091,766 A * 5/1978 Colliard ..... A01K 27/005 119/858
4,179,833 A * 12/1979 Knodel ..... G09F 3/14 40/586
4,813,369 A * 3/1989 Moreland ..... G08B 5/00 116/173

(Continued)

FOREIGN PATENT DOCUMENTS

AT 10081 U1 * 8/2008 ..... G09F 15/0025
DE WO 2013164654 A1 * 11/2013 ..... G09F 21/02

(Continued)

*Primary Examiner* — R. A. Smith

(57) ABSTRACT

A vertically oriented support member has a circumference. A flag has an interior edge and an exterior edge separated by a length. The flag has an upper edge and a lower edge separated by a height. The flag has a first surface and a second surface. First fasteners are on the first surface adjacent to the interior edge of the flag. Second fasteners are on the first surface parallel with and laterally spaced from the interior edge. The second fasteners are spaced from the first fasteners by a distance at least equal to the circumference of the support member. A portion of the flag between the first fasteners and second fasteners is secured to and encompasses the support member. Indicia is provided on the flag. The indicia is closer to the exterior edge than to the interior edge.

10 Claims, 6 Drawing Sheets

(56) References Cited

U.S. PATENT DOCUMENTS

| | | | | | |
|---|---|---|---|---|---|
| 5,517,941 | A * | 5/1996 | Fisher | G09F 17/00 | 116/173 |
| 5,540,181 | A * | 7/1996 | Pearce | G09F 17/00 | 116/173 |
| 5,881,384 | A * | 3/1999 | Williams | G09F 21/02 | 2/158 |
| 5,975,390 | A * | 11/1999 | Saroli | A63B 57/00 | 224/274 |
| 6,405,381 | B1 * | 6/2002 | Bowman, Jr. | A41D 19/0051 | 2/159 |
| 6,584,927 | B1 * | 7/2003 | Iversen | G09F 17/00 | 116/173 |
| D570,246 | S * | 6/2008 | Spicer | D11/166 | |
| 7,520,074 | B1 * | 4/2009 | Vanova | G09F 21/02 | 116/173 |
| D668,989 | S * | 10/2012 | Wilson et al. | D11/165 | |
| 9,087,462 | B1 * | 7/2015 | Gallus | G09F 17/00 | |
| 9,371,118 | B2 * | 6/2016 | King et al. | B63C 9/00 | |
| 2005/0101414 | A1 * | 5/2005 | DiGregorio | A63B 57/00 | 473/407 |
| 2014/0026286 | A1 * | 1/2014 | Hendley et al. | G09F 21/02 | 2/69 |
| 2014/0313761 | A1 * | 10/2014 | Nelson-Herron | G09F 17/00 | 362/523 |
| 2015/0090177 | A1 * | 4/2015 | Allen | G09F 17/00 | 116/173 |

FOREIGN PATENT DOCUMENTS

| | | | | | |
|---|---|---|---|---|---|
| DE | 202013010200 | U1 * | 12/2013 | G09F 21/026 | |
| EP | 1855265 | A1 * | 11/2007 | G09F 17/00 | |
| GB | 2498240 | A * | 7/2013 | G09F 17/00 | |
| JP | 3152683 | U * | 8/2009 | G09F 17/00 | |
| KR | 20120102245 | A * | 9/2012 | A63B 69/36 | |

* cited by examiner

FIG. 1
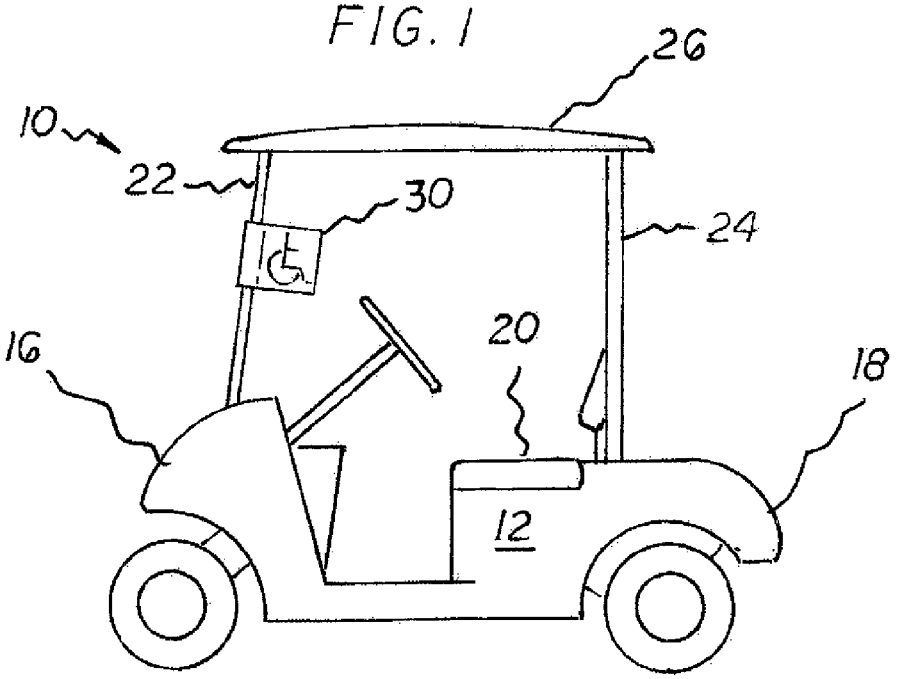
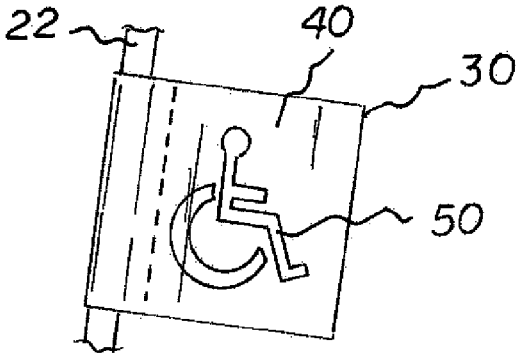
FIG. 2
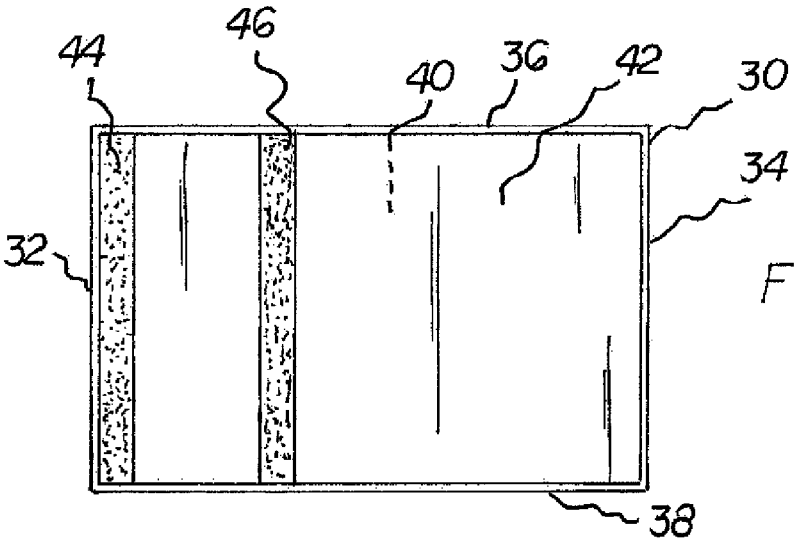
FIG. 3

FIG. 9
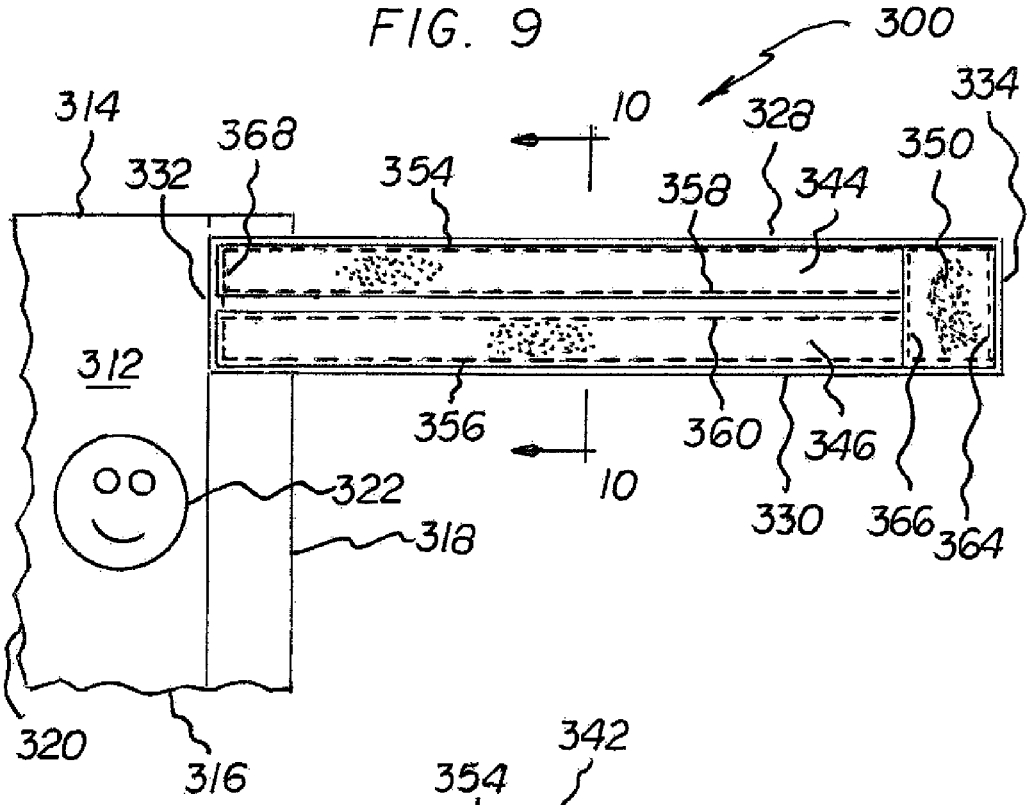
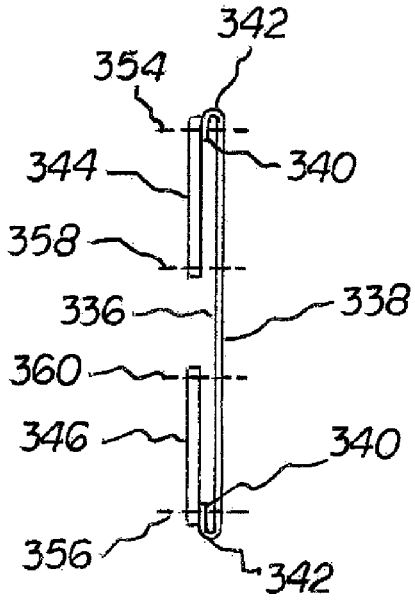
FIG. 10

FIG. 13
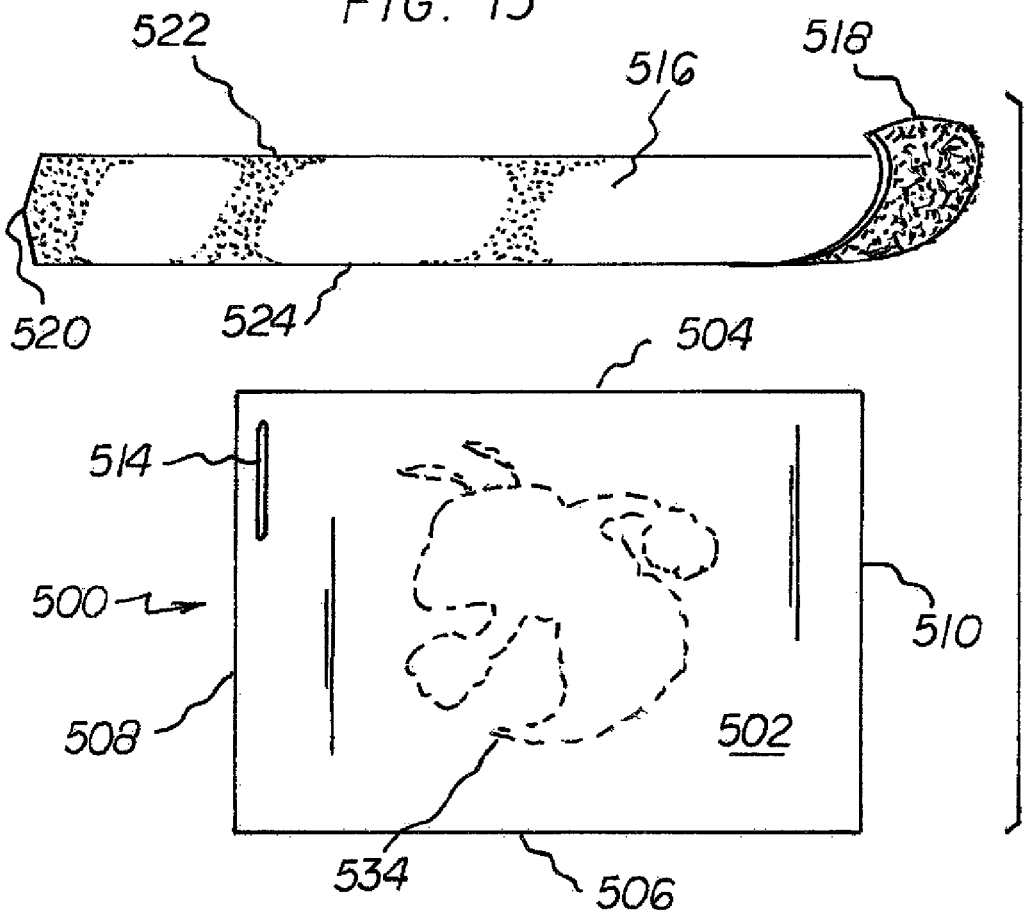
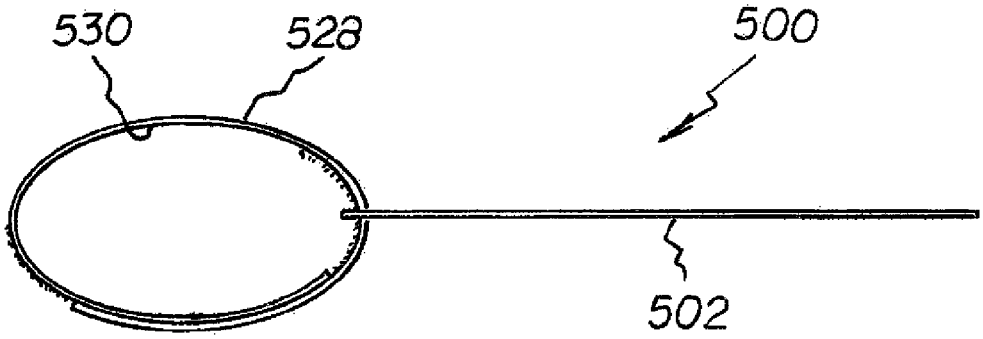
FIG. 14

FLAG/TEAM WAVE SYSTEM

RELATED APPLICATION

The present non-provisional patent application is a continuation-in-part of pending application Ser. No. 15/042,787 filed Mar. 28, 2016 which is based upon Provisional Application No. 62/193,946 filed Jul. 17, 2015, and which claims the benefit of the filing date of such applications and which incorporates by reference the subject matter of such applications.

BACKGROUND OF THE INVENTION

Field of the Invention

The present invention relates to a flag/team wave system and more particularly pertains to removably coupling a flag to a golf cart and for displaying a message from the golf cart, the removably coupling and the displaying of a message being done in a safe, convenient, and economical manner.

SUMMARY OF THE INVENTION

In view of the foregoing disadvantages inherent in the known types of flag systems of known designs and configurations now present in the prior art, the present invention provides an improved flag/team wave system. As such, the general purpose of the present invention, which will be described subsequently in greater detail, is to provide a new and improved flag/team wave system and method which has all the advantages of the prior art and none of the disadvantages.

From a broad viewpoint, the present invention is a flag/team wave system. First provided is a vertically oriented support member. The support member has a circumference. A flag is next provided. The flag has an interior edge and an exterior edge. The interior edge and the exterior edge are separated by a length. The flag has an upper edge and a lower edge. The upper edge and the lower edge are separated by a height. The flag has a first surface and a second surface. First fasteners are provided on the first surface adjacent to the interior edge of the flag. Second fasteners are provided on the first surface parallel with and laterally spaced from the interior edge. The second fasteners are spaced from the first fasteners by a distance at least equal to the circumference of the support member. A portion of the flag between the first fasteners and second fasteners is secured to and encompasses the support member. Indicia is provided on the flag. The indicia is closer to the exterior edge than to the interior edge.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved flag/team wave system which has all of the advantages of the prior art flag systems of known designs and configurations and none of the disadvantages.

It is another object of the present invention to provide a new and improved flag/team wave system which may be easily and efficiently manufactured and marketed.

It is further object of the present invention to provide a new and improved flag/team wave system which is of durable and reliable constructions.

An even further object of the present invention is to provide a new and improved flag/team wave system which is susceptible of a low cost of manufacture with regard to both materials and labor, and which accordingly is then susceptible of low prices of sale to the consuming public, thereby making such flag/team wave system economically available to the buying public.

Lastly, another object of the present invention is to provide a flag/team wave system for removably coupling to a golf cart and for displaying a message from the golf cart, the removably coupling and the displaying a message being done in a safe, convenient, and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of a golf cart with a flag/team wave system constructed in accordance with the principles of the present invention, the system being on a forward portion of the golf cart.

FIG. 2 is an enlarged showing of the flag/team wave system illustrated in FIG. 1.

FIG. 3 is a front elevational view of the flag of FIGS. 1 and 2 with the flag removed from the golf cart.

FIG. 9 is a front elevational view of a flag waving system constructed in accordance with the preferred embodiment of the invention.

FIG. 10 is a cross sectional view taken along line 10-10 of FIG. 9.

FIG. 13 is a front elevational view of a flag/team wave system constructed in accordance with a second primary embodiment of the present invention.

FIG. 14 is a plan view taken along line 14-14 of FIG. 13;

The same reference numerals refer to the same parts throughout the various Figures.

DESCRIPTION OF THE PREFERRED EMBODIMENT

Figure 4:
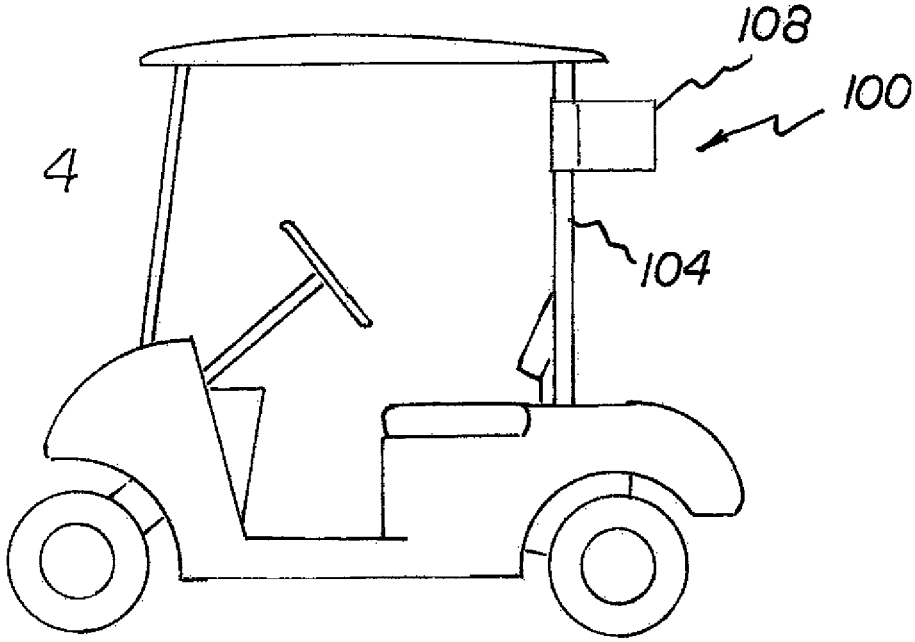
FIG. 4 is a side elevational view of a golf cart with a flag/team wave system constructed in accordance with an alternate embodiment of the present invention, the system being on a rearward portion of the golf cart.

With reference now to the drawings, and in particular to FIG. 1 thereof, the preferred embodiment of the new and improved flag/team wave system embodying the principles and concepts of the present invention and generally designated by the reference numeral 10 will be described.

The present invention, the flag/team wave system 10 is comprised of a plurality of components. Such components in their broadest context include a support member and a flag. Such components are individually configured and correlated with respect to each other so as to attain the desired objective.

From a specific viewpoint, the present invention is a flag/wave system. First provided is a golf cart 12. The golf cart has a forward end 16 and a rearward end 18. The golf cart has a seat 20. The seat is between the forward end and the rearward end. The golf cart has laterally spaced forward posts 22. The lower ends of the forward posts are secured adjacent to the forward end. The golf cart has laterally spaced rearward posts 24. The lower ends of the rearward posts are secured adjacent to the rearward end. The forward posts and the rearward posts have upper ends. The golf cart has a roof 26. The roof is supported by the upper ends of the forward posts and the rearward posts. The forward posts have a circumference of from 5 inches to 6 inches. The rearward posts have a circumference of from 8 inches to 10 inches.

Also provided is a flag 30. The flag has an interior edge 32 and an exterior edge 34. The interior edge and the exterior edge are separated by a length of 24 inches, plus or minus 20 percent. The flag has an upper edge 36 and a lower edge 38. The upper edge and the lower edge are separated by a height of 18 inches, plus or minus 20 percent. The flag has a first surface 40 and a second surface 42. A first strip 44 of hook and loop fasteners is provided n the first surface adjacent to the first edge. The first strip of hook and loop fasteners extends between the upper edge and the lower edge. A second strip 46 of hook and loop fasteners is provided on the first surface parallel with and laterally spaced from the first edge. The second strip of hook and loop fasteners extends between the upper edge and the lower edge. The second strip is spaced from the first strip by a distance equal to the circumference of one of the forward posts. A portion of the flag between the first and second strips of fasteners is secured to one of the forward posts closer to the upper end of the forward post than the lower end of the forward post. The flag has a handicap symbol 50. The handicap symbol is remote from the first and second strips of fasteners. Such components are individually configured and correlated with respect to each other so as to attain the desired objective.

Figure 5:
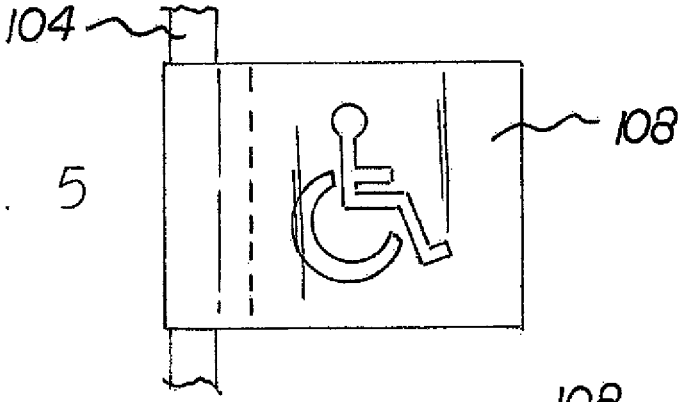
FIG. 5 is an enlarged showing of the flag/team wave system illustrated in FIG. 4.
Figure 6:
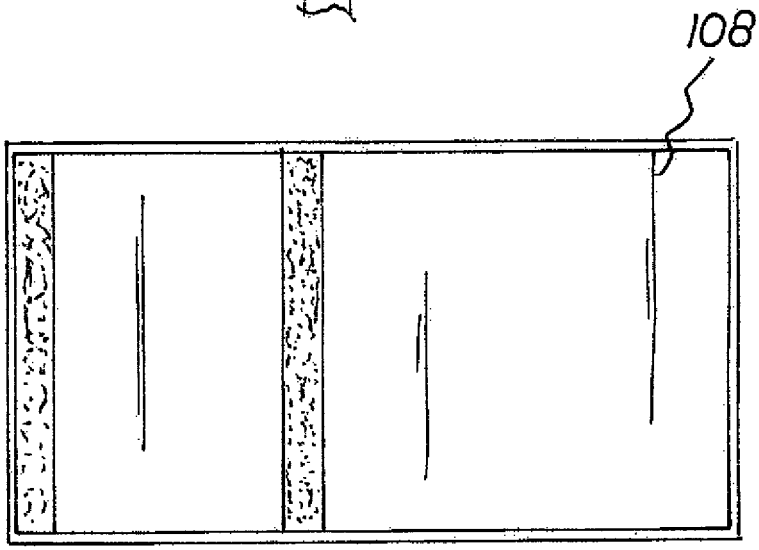
FIG. 6 is a front elevational view of the flag of FIGS. 4 and 5 with the flag removed from the golf cart.

Reference is now made to the alternate embodiment of the invention illustrated in FIGS. 4, 5, and 6. In this embodiment of the system 100, the support member 104 for the flag 108 is a rearward post of a golf cart and the distance between the first and second strips of fasteners is from 8 to 10 inches.

Figure 7:
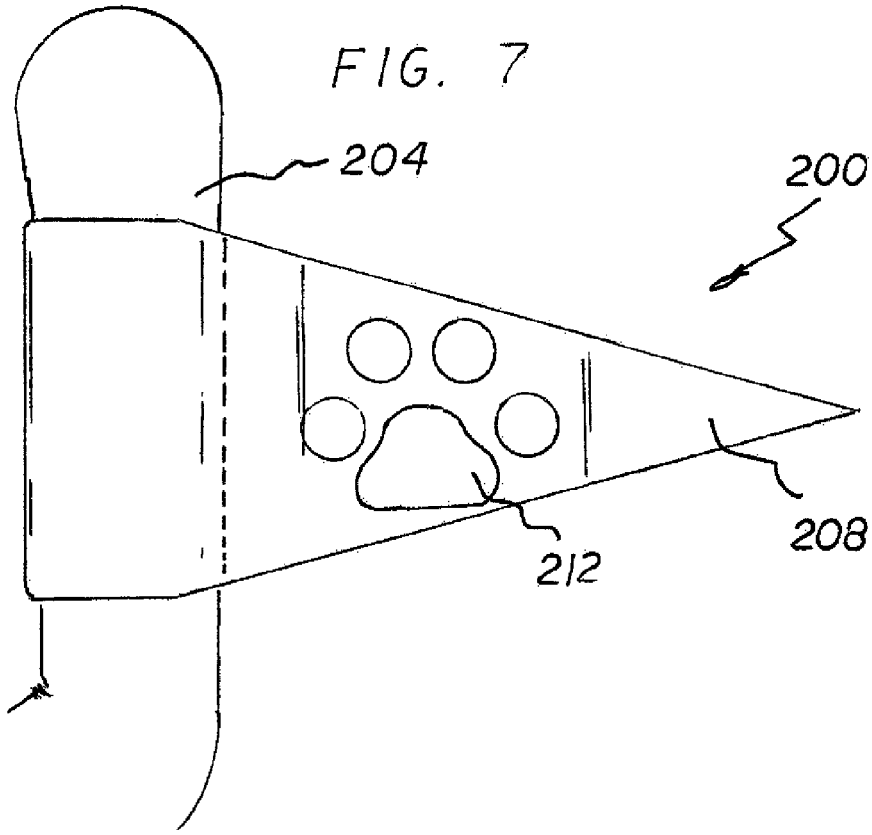
FIG. 7 is a side elevational view of an enlarged support with a flag/team wave system constructed in accordance with another alternate embodiment of the present invention.
Figure 8:
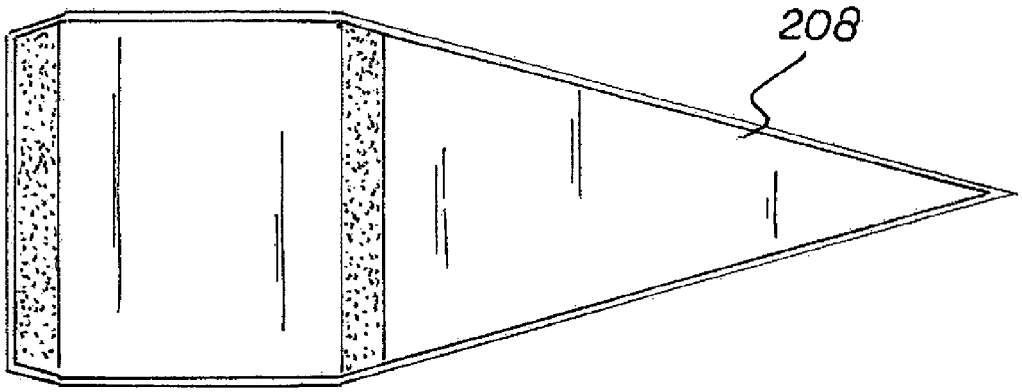
FIG. 8 is front elevational view of the flag of FIG. 7 with the flag removed from the enlarged support.

Another alternate embodiment of the invention is shown in FIGS. 7 and 8. In this alternate embodiment 200, the support member 204 is an arm of a sports fan. The distance between the first and second strips of fasteners is from 10 to 16 inches.

In another alternate embodiment, the flag 208 is triangular and is remote from the first and second fasteners.

In another alternate embodiment of the invention the indicia is a sports logo 212. The sports logo may be on the first surface and/or the second surface. Different sports logos may be on opposite surfaces of the flag. Further, one person may utilize two flags, one on each arm.

In the last, and preferred, embodiment 300 of the present invention, the flag 312 is formed in a rectangular configuration. The flag has a horizontal top 314 and a horizontal bottom 316. The top and bottom are separated by an elevational dimension. The flag has a vertical interior 318. The flag has a vertical exterior 320. The interior and the exterior are separated by a lateral dimension. The flag has a front and a back with indicia 322 displayed.

A strap 326 is provided. The strap is formed in a rectangular configuration. The strap has a horizontal upper edge 328 and a horizontal lower edge 330. The upper edge and the lower edge are separated by a height of 5 centimeters. The strap has a vertical interior edge 332 and a vertical exterior edge 334. The interior edge and the exterior edge are separated by a length of 28.5 centimeters. The strap has a front surface 336 and a back surface 338. The upper edge, the lower edge, the interior edge, and the exterior edge have up-turned extents 340 forming peripheral bends 342.

An upper strip 344 of loop fasteners is provided. The upper strip is positioned on the front surface of the strap. The upper strip covers an upper extent of the strap laterally from the interior edge to a location adjacent to the exterior edge. The upper strip covers an upper extent of the strap elevationally from the upper edge to a location 3 centimeters from the lower edge. A lower strip 346 of loop fasteners is provided. The lower strip is positioned on the front surface of the strap. The lower strip covers a lower extent of the strap laterally from the interior edge to a location adjacent to the exterior edge. The lower strip covers a lower extent of the strap elevationally from the lower edge to a location 3 centimeters from the upper edge.

A vertical strip 350 of hook fasteners is provided. The vertical strip is positioned on the front surface of the strap. The vertical strip extends elevationally from the upper edge to the lower edge. The vertical strap expands laterally from the exterior edge to a location 24 centimeters from the interior edge.

Next, a plurality of horizontal stitching lines are provided. The horizontal stitching lines include a first horizontal stitching line 354, a second horizontal stitching line 356, a third horizontal stitching line 358, and a fourth horizontal stitching line 360. The first horizontal stitching line 354 extends through an upper peripheral edge of the upper strip and through the up-turned extent and through the strap adjacent to the upper edge and through the interior of the flag adjacent to the top. The second horizontal stitching line 356 extends through a lower peripheral edge of the lower strip and through the up-turned extent and through the strap adjacent to the lower edge and through the interior of the flag adjacent to the top. The third horizontal stitching line 358 extends through a lower peripheral edge of the upper strip and through the strap and through the interior of the flag adjacent to the top. The fourth horizontal stitching line 360 extending through an upper peripheral edge of the lower strip and through the strap and through the interior of the flag adjacent to the top.

A plurality of vertical stitching lines are next provided. The vertical stitching lines include a first vertical stitching line 364, a second vertical stitching line 366, and a third vertical stitching line 368. The first vertical stitching line 364 extends through an exterior peripheral edge of the vertical strip. The first vertical stitching line then extends through the up-turned extent. The first vertical stitching line extends further through the strap adjacent to the exterior edge. The second vertical stitching line 366 extends through the vertical strip. The second vertical stitching line then extends through the strap laterally spaced from the exterior edge. The third vertical stitching line 368 extends through the strap. The third vertical stitching line then extends through the up-turned extent. The third vertical stitching line then extends through the upper and lower strips adjacent to the interior edge. The third vertical stitching line further extends through the interior of the flag adjacent to the top.

In this manner, the exterior edge of the strap may be folded with the vertical strip 350 in contact with the upper strip 344 and lower strip 346 adjacent to the interior edge. In this manner an arm loop is formed. The arm loop receives the user's arm so that moving of the user's arm will wave the flag.

Indicia includes indicia chosen from the class of indicia consisting of a country, a team and a political entity. The preferred elevational dimension of the flag is 19 centimeters and the preferred lateral dimension is 30 centimeters. Another elevational dimension of the flag is 11 centimeters and the lateral dimension is 15 centimeters. The strap has a preferred height of 5 centimeters and a length of 28.5 centimeters.

Figure 11:
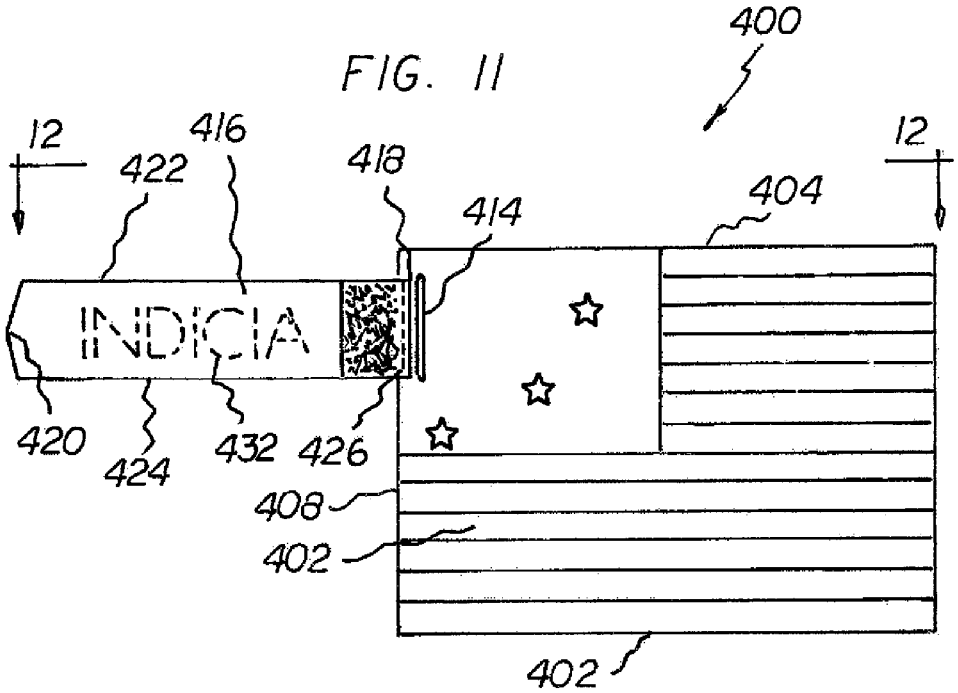
FIG. 11 is a front elevational view of a flag/team wave system constructed in accordance with the primary embodiment of the present invention.
Figure 12:
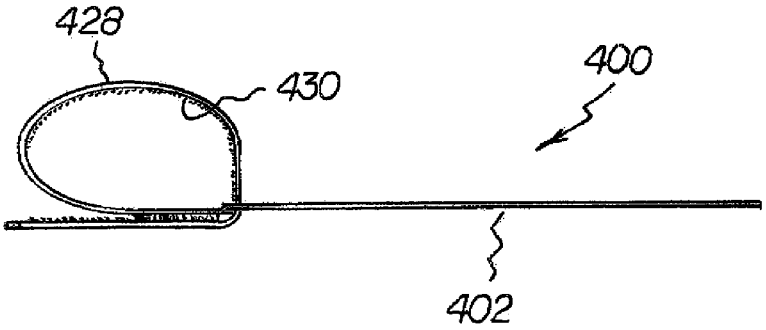
FIG. 12 is a plan view taken along line 12-12 of FIG. 11.

FIGS. 11 and 12 illustrate the primary embodiment of the invention. In such embodiment, the system 400 includes a flag 402 has an upper edge 404 and a lower edge 406 and an inner edge 408 and an outer edge 410. A slot 414 is cut into the flag parallel with and adjacent to the inner edge adjacent to the upper edge. The inner edge has a first height and the slot has a second height. The second height is between 20 and 35 percent Of the first height.

In such embodiment, a strap 416 is also provided. The strap has an inner edge 418 and an outer edge 420 and an upper edge 422 and a lower edge 424. The strap has a height essentially equal to the second height. The strap has a length between 3 and 6 times the height of the strap. A line of stitching 426 couples the inner end of the strap to the flag between the slot and the inner edge of the flag.

The strap has an outside 428 formed of a smooth material over the majority of its surface with a patch of hook fasteners adjacent to the slot. The strap has an inside 430 formed with loop fasteners. The outer end of the strap extends downwardly throughout the slot with the loop fasteners releasably coupling with the hook fasteners to removably secure the strap around a users arm. The inner edge of the strap is cut to a point for facilitating threading the strap through the slot.

Indicia 432 is on the smooth surface on the outside of the strap.

FIGS. 13 and 14 illustrate a second primary embodiment of the invention. In such embodiment, the flag 502 has an upper edge 504 and a lower edge 506 and an inner edge 508 and an outer edge 510. A slot 514 is cut into the flag parallel with and adjacent to the inner edge adjacent to the upper edge. The inner edge has a first height and the slot has a second height. The second height is between 20 and 35 percent Of the first height.

In such embodiment, a strap 516 is also provided. The strap has an inner edge 518 and an outer edge 520 and an upper edge 522 and a lower edge 524. The strap has a height essentially equal to the second height. The strap has a length between 3 and 6 times the height of the strap.

The strap has an outside 528 formed of a smooth material over the majority of its surface with a patch of hook fasteners adjacent to the slot. The strap has an inside 530 formed with loop fasteners. The outer end of the strap extends downwardly throughout the slot with the loop fasteners releasably coupling with the hook fasteners to removably secure the strap around a users arm. The inner edge of the strap is cut to a point for facilitating threading the strap through the slot.

Indicia 534 is on the flag.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A flag handling system comprising:

the flag having a top and a bottom separated by an elevational dimension, the flag having a vertical interior and a vertical exterior separated by a lateral dimension; and a strap formed in a rectangular configuration having horizontal upper and lower edges separated by a height, the strap having a vertical interior and exterior edges separated by a length, the strap having a front face and a rear face;

a horizontal strip of fasteners positioned on the front face of the strap laterally from the interior edge to a location spaced from the exterior edge;

a vertical strip of fasteners positioned on the front face of the strap extending elevationally from the upper edge to the lower edge and extending laterally from the exterior edge to a location spaced from the interior edge whereby the strap may be folded with the vertical strip in contact with the horizontal strip to form a loop;

horizontal stitching lines coupling the horizontal strip to the strap and the flag; and vertical stitching lines coupling the vertical strip to the strap.

2. The system as set forth in claim 1 wherein the flag includes indicia chosen from the class of indicia consisting of a country, a team and a political entity.

3. The system as set forth in claim 1 wherein the flag has an elevational dimension of 19 centimeters and a lateral dimension of 30 centimeters.

4. The system as set forth in claim 1 wherein the flag has an elevational dimension of 11 centimeters and a lateral dimension of 15 centimeters.

5. The system as set forth in claim 1 wherein the strap has a height of 5 centimeters and a length of 28.5 centimeters.

6. The system as set forth in claim 1 wherein the horizontal strip is a loop fastener and the vertical strip is a hook fastener whereby an exterior edge of the strap may be folded with the vertical strip in contact with the horizontal strip adjacent to the interior edge of the strap to form an arm loop to receive the user's arm for waving the flag by moving the user's arm and waving the flag.

7. A flag handling system (400) (500) comprising a flag (402) (502) having an upper edge (404) (504) and a lower edge (406) (506) and an inner edge (408) (508) and an outer edge (410) (510), a slot (414) (514) cut into the flag parallel with and adjacent to the inner edge adjacent to the upper edge, the inner edge having a first height and the slot has a second height, the second height being between 20 and 35 percent of the first height;

a strap (416) having an inner edge (418) (518) and an outer edge (420) (520) and an upper edge (422) (522) and a lower edge (424) (524), the strap having a height essentially equal to the second height, the strap having a length between 3 and 6 times the height of the strap;

the strap having an outside (428) (528) formed of a smooth material over the majority of its surface with a patch of hook fasteners adjacent to the slot, the strap having an inside (430) (530) formed with loop fasteners, the outer end of the strap extending downwardly through the slot with the loop fasteners releasably coupling with the hook fasteners to removably secure the strap around a user's arm, the inner edge of the strap being cut to a point for facilitating threading the strap through the slot.

8. The system as set forth in claim 7 and further including:

indicia (432) is on the smooth surface on the outside of the strap.

9. The system as set forth in claim 7 and further including:

indicia (534) is on the flag.

10. The system as set forth in claim 7 and further including:

a line of stitching (426) coupling the inner edge of the strap to the flag between the slot and the inner edge of the flag.

* * * * *